United States Patent [19]

Lake

[11] Patent Number: 4,992,700

[45] Date of Patent: Feb. 12, 1991

[54] REPROGRAPHIC METAL HALIDE LAMPS HAVING HIGH BLUE EMISSION

[75] Inventor: William H. Lake, Macedonia, Ohio

[73] Assignee: General Electric Company, Schenectady, N.Y.

[21] Appl. No.: 322,148

[22] Filed: Mar. 10, 1989

[51] Int. Cl.[5] ..... H01J 61/18; H01J 61/20; H01J 61/22

[52] U.S. Cl. ..... 313/639; 313/638; 313/642

[58] Field of Search ..... 313/638, 639, 642, 640, 313/641, 570, 571

[56] References Cited

U.S. PATENT DOCUMENTS

| | | | |
|---|---|---|---|
| 3,234,421 | 2/1966 | Reiling | 313/571 X |
| 3,259,777 | 7/1966 | Fridrich | 313/570 |
| 3,445,719 | 5/1969 | Thouret et al. | 313/571 X |
| 3,840,767 | 10/1974 | Lake | 313/639 |
| 3,852,630 | 12/1974 | Wesselink et al. | 313/640 |
| 3,876,895 | 4/1975 | Lake | 313/642 X |
| 3,919,581 | 11/1975 | Datta . | |
| 3,982,154 | 9/1976 | Mize et al. . | |
| 4,253,037 | 2/1981 | Driessen et al. | 313/571 X |

*Primary Examiner*—Palmer C. DeMeo
*Attorney, Agent, or Firm*—Edward M. Corcoran; Stanley C. Corwin; Fred Jacob

[57] ABSTRACT

Metal halide vapor arc lamps for reprographic and projection processes emitting in the blue, green and red bands with excellent primary color separation and having significant blue emission at a wavelength of about 450 nm, contain a fill of indium, zinc, lithium and thallium iodides.

33 Claims, 2 Drawing Sheets

Fig. 3
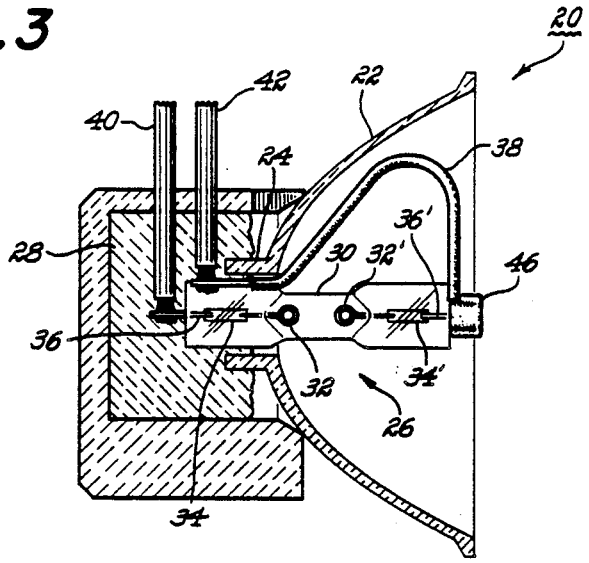
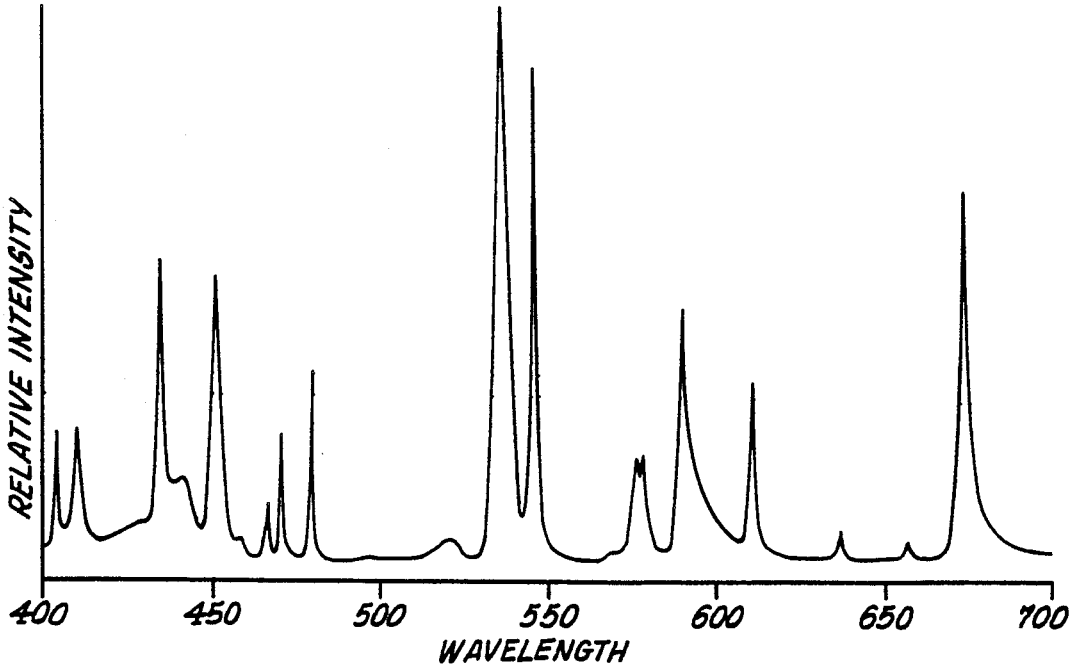
Fig. 4

REPROGRAPHIC METAL HALIDE LAMPS HAVING HIGH BLUE EMISSION

BACKGROUND OF THE INVENTION

1. Field of the Invention

This invention relates to selective spectral output metal halide arc discharge lamps containing a halide of indium. More particularly, this invention relates to selective spectral output metal halide vapor arc lamps for reprographic and photographic processes emitting in the blue, green and red bands with at least a portion of the blue radiation being emitted at a wavelength of about 450 nm, wherein the metal halide arc tube contains a fill which comprises a mixture of halides of indium, zinc, lithium and thallium.

2. Background of the Disclosure

Lamps intended for general lighting are designed to achieve the highest visible light radiation efficiency possible together with high color rendition at a specified color temperature. In most cases, this has resulted in solving problems to provide sufficient red radiation in order to achieve a good color rendition of the white light. In such lamps, the electrical characteristics are essentially those of a mercury discharge. However, there are other applications for electric lamps wherein emission scattered throughout the visible spectrum is undesirable. For instance, in reprographic applications for making colored copies, radiation concentrated in the three primary colors, blue, green and red is desired. The three primary colors can be achieved from light sources emitting continuously throughout the visible spectrum by means of filters. In this type of application the light beams are provided either from three separate light sources or by splitting the beam from a single white light source by means of optical filters. Such filters are used to eliminate from the light path everything except the desired primary color, and the three primary colors may then be recombined into a single beam. Such systems are prohibitively expensive as well as inefficient. Similarly, in some photochemical applications high energy emission in specific regions or bands is required in order to achieve a desired chemical reaction, and emission in other bands must be suppressed because it may inhibit the desired reaction and even produce undesirable side reactions.

The principles of color reproduction processes utilizing the three primary colors are well known. In such processes it is important that the light source employed emit radiation in the three primary color spectrums, blue, green and red at wavelengths which will be efficient in producing the desired reaction in the dyes and/or other chemical reagents used. In most color reprographic systems, the dyes, etc., which react with blue light are relatively insensitive to the light radiation in the blue color range. Also, blue light radiation is more readily absorbed by most media which results in low transmission. Consequently, lamps employed with such processes should emit a relatively high level of blue radiation in order to efficiently and effectively produce the desired chemical reaction and concomitant color change in the paper, emulsion, slide, phosphor, liquid crystal or other substrate.

Projection television systems also require light emission in the three primary colors, blue, green and red. The three primary colors containing the desired image or signal are separately projected on a screen wherein the colors combine to produce a desired light image.

For color projection processes the primary objectives are good color reproduction and high screen brightness after passing through a medium in which the color information is contained (i.e., liquid crystals, slides, screens), with the lowest possible amount of power dissipation in the light radiation.

U.S. Pat. Nos. 3,840,767 and 3,876,895 describe selective spectral output metal halide vapor arc discharge lamps having light emissions concentrated in the blue, green and red energy bands wherein the relative emission characteristics or energy levels in the three bands are approximately 1:2:2, respectively and wherein little or no blue radiation is emitted at a wavelength of about 450 nm. Both of these lamps contain a fill comprising a mixture of halides of zinc, lithium and thallium, with the lamp of the '767 patent additionally containing a halide of gallium.

SUMMARY OF THE INVENTION

The present invention relates to metal halide lamps providing a source of radiation concentrated in the blue, green and red bands or regions of the visible light spectrum constituting the three primary colors. More particularly the present invention relates to a metal halide vapor arc discharge lamp containing a fill comprising a mixture of indium, zinc, lithium, thallium and at least one halogen. After the lamp has been energized the fill will comprise a mixture of indium, zinc, lithium and thallium halides, and preferably the iodides of these metals. These lamps emit a significant amount of blue radiation at a wavelength of about 450 nm and, in some embodiments, have a blue to red energy emission ratio greater than 1:1. Additional blue emission is provided over a relatively broad range of from about 400 to 480 nm. In general, the emission energy ratio of the blue to red color emission of the lamps of this invention will range from about 0.8 to about 11:1. The lamps of this invention may be designed to operate at a color temperature of from about 6000° K to as high as 15,000° K.

BRIEF DESCRIPTION OF THE DRAWINGS

FIG. 3 illustrates a lamp assembly employing a compact metal halide arc discharge lamp according to an embodiment of the present invention wherein the arc chamber also contains mercury.

FIG. 4 is a graph illustrating the spectral output of the visible light emitted by a lamp of the type illustrated in FIG. 3 in accordance with the present invention.

DETAILED DESCRIPTION

Figure 1:
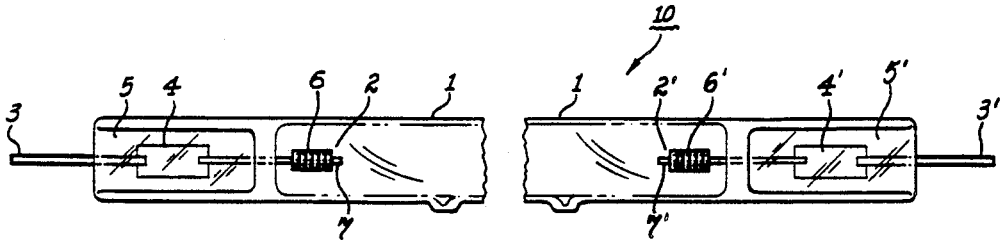
FIG. 1 illustrates a linear type of metal halide arc discharge lamp useful in the present invention.

According to the present invention, metal halide vapor arc discharge lamps containing a fill comprising a mixture of indium, zinc, lithium and thallium halides emit visible light radiation in the blue, green and red bands. In one embodiment most or at least a significant amount of the blue emission occurs at a wavelength of about 450 nm. The blue to red energy emission ratio of these lamps may range from about 0.8:1 up to about 11:1. By halides is meant the iodides, bromides, chlorides and mixtures thereof. Preferably only the iodides or bromides will be used. In a preferred embodiment the lamp will contain a mixture of only the iodides of these metals. In a particularly preferred embodiment of the invention, the blue, green and red bands will predominantly radiate at the wavelengths defined as follows:

| | |
|---|---|
| Blue | 400–480 nm |
| Green | 500–560 nm |
| Red | 600–700 nm |

and with emitted energy levels within the blue and red bands in a ratio of at least about 1:1 of blue to red radiation. In this particular embodiment, visible radiation in the regions between the blue, green and red bands is undesirable and is preferably kept as low as possible. By undesirable radiation in the regions between the blue, green and red bands is meant radiation occurring between 570–600 nm and 480–510 nm.

It has been found that cleaner and crisper color images are achieved when radiation between the three primary color bands is reduced, particularly that which occurs between 480–510 nm and 570–600 nm. Thus, the more separate the three bands of emitted color are the cleaner the color reproduction becomes. Concomitantly, this color separation improves the lamp efficiency. By way of example, lamps of the present invention have been made which have an efficiency defined as the total visible band output energy to the total input energy of ten times that of typical tungsten-halogen lamps and general lighting metal halide lamps. Light radiation in regions of overlap between color bands, particularly 480–510 nm and 570–600 nm, increases image brightness at the expense of color information, thereby making an image appear over-exposed. The present invention substantially reduces and minimizes the energy emitted in these image confusing regions and permits the utilization of inexpensive color separating media without degrading image quality.

Accordingly, for some applications of color reproduction the lamps of the present invention have been found to produce cleaner and crisper images than has heretofore been possible. Further, the relatively high blue output has enabled lamps of the present invention to be useful in color projection processes wherein the final color image quality is closer to that occurring with natural sunlight than has heretofore been achieved. This is because the intensity of these primary color bands can be more evenly distributed in color reproduction and transmission systems that, for one reason on other, result in significant absorption of blue light radiation. Still further, if desired the lamps of the present invention can be made to be useful for general lighting purposes wherein the color temperature is below about 6,000° K and the blue to red emission energy ratio is below 0.8:1.

As set forth above, the lamps of the present invention comprise a metal halide arc discharge tube which contains a mixture of indium, zinc, lithium, thallium and at least one halogen. During operation the metals are present as the halides of indium, zinc, lithium and thallium. The indium, lithium and thallium halides are the color emitting species and the zinc halide is a buffer species for controlling the electrical characteristics and chemical kinetics of the discharge. The zinc halide buffer species augments the radiation from the three emitter species and may also reduce electrophoretic or chemical processes tending to deplete any of the emitter species or which may attack the wall of the vitreous envelope enclosing the arc. In the lamps of the present invention the indium provides the light radiation in the blue portion of the spectrum.

The lamps according to the present invention will also contain one or more inert gases and preferably one or more noble gases such as xenon, argon, krypton and mixture thereof as a starting gas. Xenon is particularly preferred from an energy/efficiency standpoint. The inert gas will generally be employed in the arc tube at a pressure below about 760 torr but could be used at higher pressures if the arc chamber is designed to innocuously contain the desired pressure. Mercury may also be employed in the fill if desired. The use of mercury in accordance with the present invention will generally be used only in lamps in which the starting gas consists predominantly of argon and in compact lamps wherein the length of the arc is on the order of about 3 centimeters or less. If mercury is employed as part of the lamp fill in a lamp according to the invention wherein the length of the arc is greater than about 3 cm, such as in a linear lamp of the type illustrated in FIG. 1, the amount will generally be less than about 1 mg/cc ($5\times10^{-6}$ mole/cc) of arc tube volume and preferably less than about 0.25 mg/cc ($1.25\times10^{-6}$ mole/cc). The use of mercury will impair the blue, green and red color separation characteristics of the lamps and also reduce lamp efficacy while at the same time increasing the amount of power input that is lost as heat. The more mercury used, the worse will be both the efficacy and color separation characteristics.

It is preferred that the amount of In present in the arc tube will not exceed about 25 mole % of the combined total moles of the indium, zinc, lithium and thallium present in the arc tube. By way of an illustrative, but non-limiting example of the present invention wherein the metal halide species are in the form of the metal iodides, the amount of indium iodide, InI, present in the arc tube will broadly range from between about 0.01 mg/cc ($4\times10^{-8}$ mole/cc) to 1.5 mg/cc ($6\times10^{-6}$ mole/cc) of internal arc tube volume; the amount of zinc iodide, $ZnI_2$, will range from about 0.02–1.5 mg/cc or $6\times10^{-8}$ to $5\times10^{-6}$ mole/cc; the amount of lithium iodide, LiI, will range from about 0.01–1.5 mg/cc or $7\times10^{-8}$ to $2\times10^{-5}$ mole/cc and the amount of thallium iodide, TlI, will range from about 0.02–1.0 mg/cc or $6\times10^{-8}$ to $3\times10^{-6}$ mole/cc of internal arc tube volume. In lamps wherein the arc length is about 3 mm or more, the amount of indium iodide will generally range from about 0.01–0.6 milligrams per cubic centimeter of arc tube volume ($7\times10^{-8}$ to $2.5\times10^{-6}$ moles/cc) and preferably about 0.02–0.5 mg/cc ($1.4\times10^{-8}$ to $2.0\times10^{-6}$ mole/cc) In compact lamps according to the present invention wherein the arc length or distance between electrodes is less than about 3 mm, the amount of indium iodide present in the arc tube will range from about 0.01–1.5 mg/cc ($7\times10^{-8}$ to $6\times10^{-6}$ mole/cc) and preferably 0.1–0.9 mg/cc ($7\times10^{-7}$ to $3.8\times10^{-6}$ mole/cc). Although this illustration is for the iodides of the metals, the ranges of the amount of each of the four metals (indium, zinc, lithium and thallium) as moles per cubic centimeter of arc tube volume present in the arc tube or arc chamber will be the same as that expressed for the iodides, since each mole of iodide contains one atom of metal. Accordingly, the molar ranges of the bromides or chlorides or mixtures thereof will also be about the same as the iodides.

In lamps of the present invention having an arc length of about 3 mm or more, mercury may be added, if desired in an amount of less than about 1 mg/cc ($5\times10^{-6}$ mole/cc) and preferably no more than about 0.25 mg/cc ($1.25\times10^{-6}$ mole/cc) In contrast, more compact lamps having an arc length less than about 3 mm will contain mercury in an amount of from about 5–40 mg/cc ($2.5\times10^{-5}-2\times10^{-4}$ mole/cc) and preferably from about 20–35 mg/cc ($1\times10^{-4}-1.75\times10^{-4}$ mole/cc) The presence of such significant quantities of mercury in such compact lamps adds significantly to the amount of visible green and blue radiation, thereby requiring greater amounts of indium halide to provide a given energy balance between blue, green and red emission.

Lamp manufacturing processes vary according to equipment on hand, needs, availability of materials, etc. Accordingly, in some manufacturing processes it is possible for small quantities of oxygen and/or moisture to be present in the arc tube when it is being filled with the metal halides. This causes some of the metal halide to react with the oxygen and/or moisture, thereby releasing the halide in the arc tube. The presence of such "excess" halide in the arc tube is detrimental to the operation of the lamp. Accordingly, it has been found that the addition of zinc, as zinc metal, or amalgamated with mercury if mercury is present in the arc tube, acts as a scavenger to take up such "excess" halide without any detrimental effect on the spectral distribution of the lamp. This has been found to improve lamp efficiency in terms of watts of useful light output per watt of electrical input. The amount of zinc metal added, on a mole basis, will generally be no more than about 5 times the amount of zinc halide added or present in the arc tube and, more preferably, less than about three times the amount of zinc halide. The presence of zinc metal in the arc tube has been found to be more useful with compact lamps which have an arc length of about 3 mm or less and which contain substantial amounts of mercury. In lamps of the present invention wherein the arc length is greater than about 3 mm, indium metal may, if desired, be added to the arc tube in place of all or part of the indium halide that would otherwise be added. In such lamps the amount of indium iodide required is less than that required for the compact lamps and the indium metal will react with excess halide in the arc chamber to form indium halide. In the compact lamps in which the presence of significant quantities of mercury will generally be required, all or a portion of the mercury may be introduced into the arc tube in the form of a mercury halide (mercurous or mercuric) and, concomitantly, all or a portion of the indium, zinc and thallium may be introduced into the arc tube in the form of the metal. When the arc is energized these metals, being more reactive than mercury, will react with the halide of the mercury halide to form mercury and metal halides of the other metals in the arc tube. In this embodiment, the amount of metal (indium, zinc, thallium) added to the arc tube should be sufficient to slightly exceed the amount needed for complete reduction of the mercury halide to mercury.

FIG. 1 illustrates a linear type of metal halide vapor arc tube discharge lamp according to the present invention useful for photochemical applications and which comprises a linear arc tube having an arc length of about 15 mm, said arc tube containing a mixture of indium iodide, zinc iodide, lithium iodide and thallium iodide. Referring to FIG. 1, lamp 10 comprises arc tube 1 made of a light transmissive, vitreous envelope such as quartz or fused silica having a pair of arcing electrodes 2 and 2' sealed at each end thereof with the distance between said electrodes defining the arc gap which, in this case, is 15.5 cm. Electrode inleads 3 and 3' are attached by any suitable means, such as welding, to molybdenum foil sections 4 and 4' which are hermetically pinch sealed at each end of arc tube 10 by pinch seals 5 and 5'. Each of the two electrodes comprises a double layer tungsten wire helix 6 and 6' wrapped around a tungsten wire core 7 and 7'. If desired, a suitable electrode activating material such as thorium oxide or yttrium oxide may be applied as a coating on the turns of each helix on each electrode or as a fill in the interstices between turns or the electrode may be left uncoated. The interior of arc tube 1 contains a fill of 0.046 mg/cc ($1.9\times10^{-7}$ mole/cc) of indium iodide InI; 1.3 mg/cc of zinc iodide $ZnI_2$ ($4.1\times10^{-6}$ mole/cc); 1.0 mg/cc ($7.5\times10^{-6}$ mole/cc) of lithium iodide LiI; and 0.5 mg/cc ($1.5\times10^{-6}$ mole/cc) of thallium iodide TlI along with xenon. The xenon is at a pressure of about 300 torr.

Figure 2:
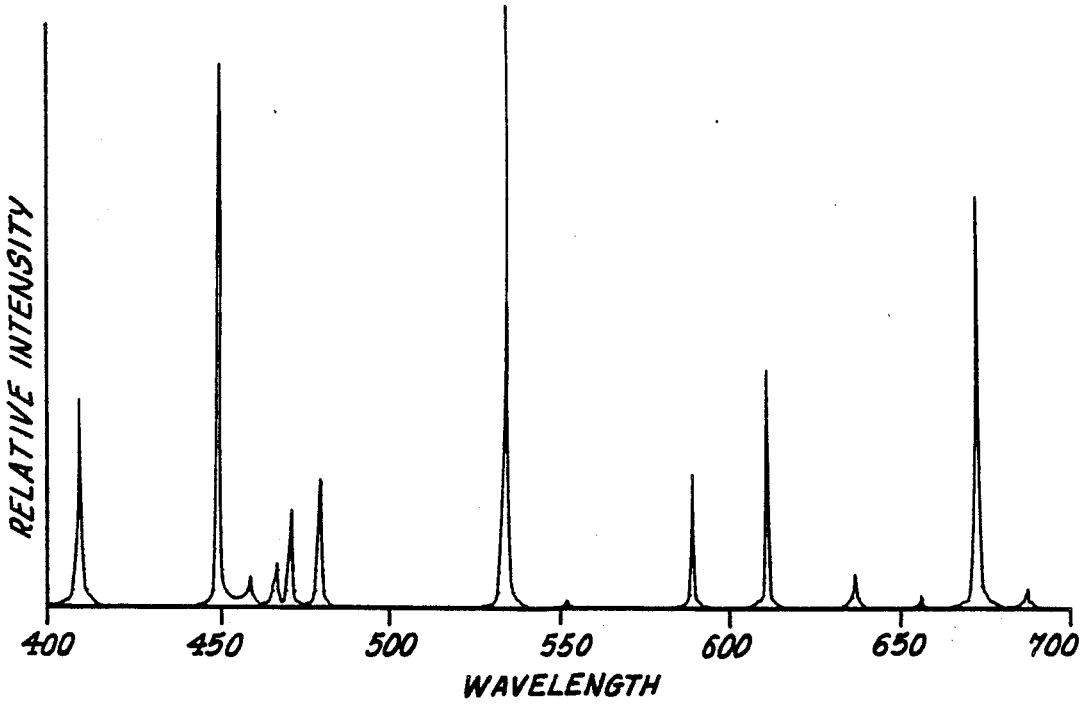
FIG. 2 is a graph illustrating the spectral output of the visible light emitted by a lamp of the type depicted in FIG. 1 in accordance with an embodiment of the present invention.

FIG. 2 is a curve of the spectral emission of a lamp of the type depicted in FIG. 1 which contained the fill set forth above. The lamp was made of quartz tubing having an outer diameter of 0.95 cm with a wall thickness of 1 mm and an arc length of 15.5 cm. This lamp was operated at about 300 watts and had a total light output of about 3200 lumens. Referring to FIG. 2, one immediately observes the relatively clean color separation between the blue, green and red primary color bands. The blue to red emission energy ratio for this lamp was about 1.6:1. Most (i.e., 50%) of the blue emission was at a wavelength of about 450 nm.

A number of 300 watt lamps of the type depicted in FIG. 1 were made of the 0.95 cm diameter quartz tubing having an arc length of 15.5 cm and a fill of 1.3 mg/cc ($4.1\times10^{-7}$ mole/cc) of zinc iodide; 1.0 mg/cc ($7.5\times10^{-6}$ mole/cc) of lithium iodide and 0.5 mg/cc ($1.5\times10^{-6}$ mole/cc) of thallium iodide with xenon at a pressure of 300 torr. The indium iodide content of these lamps ranged from 0 to 0.118 mg/cc ($9\times10^{-7}$ mole/cc). The blue to red emission energy ratio for these lamps is set forth below as a function of the indium iodide content.

| | Indium Iodide content of lamp fill in mg/cc (mole/cc)* of arc tube volume | | | | |
|---|---|---|---|---|---|
| | 0 (2.9) | 0.038 (5.8) | 0.046 (8.3) | 0.068 (21.) | 0.118 (46.) |
| Blue (400–480 nm) to Red (600–700 nm) energy ratio | 0.71 | 1.4 | 2 | 5 | 11 |

*NOTE: Mole/cc numbers are taken as $10^{-6}$ (i.e., $2.9\times10^{-6}$).

The emission spectra for these lamps was similar to that shown in FIG. 2 except for the relative emitted intensities of the blue to red visible radiation. They all exhibited the same good color separation.

FIG. 3 illustrates a compact type of lamp reflector assembly employing a compact metal halide vapor arc discharge lamp according to the present invention. Referring to FIG. 3, lamp and reflector assembly 20 consists of all glass reflector 22 having a nose portion 24 protruding rearwardly through which a compact metal halide arc tube 26 projects with the arc portion of arc tube 26 located at the optical center of reflector 22. Lamp 26 comprises arc discharge tube 30 made of quartz containing therein tungsten electrodes 32 and 32' which are looped at their ends. The distance between electrodes 32 and 32' is one-half cm. Electrodes 32 and 32' are connected at the other ends thereof by suitable means, such as welding, to molybdenum foil seal strips 34 and 34' which are pinch sealed into the respective ends of arc tube 30 and which, turn, are connected to inleads 36 and 36'. Lamp or arc tube 30 is cemented into reflector 22 by means of a suitable refractory cement 28 such as a sodium or potassium silicate cement or an aluminum phosphate type of cement which also serve to cement ceramic lamp base 44 in place. Inlead 36' at one end of lamp 26 is welded to connecting lead 38 which extends down through the nose portion 24 of the glass reflector and which is welded at its other end to lead 42. Ceramic cap 46 is cemented at the end of lamp 30 to protect the junction of inlead 36 and conductive lead 38. At the other end of lamp 26 inlead 36 is welded to conductor 40. Each of the two electrodes 32 and 32' comprises tungsten wire having a loop at the end thereof in order to confine the electrode dissipation within the arc chamber and to efficiently utilize heat energy toward maximizing the temperature within the arc chamber and consequently the halide vapor density. The interior of arc tube 30 has a volume of 0.27 cc and contains a fill consisting of 28 mg/cc ($1.4\times10^{-4}$ mole/cc) of mercury, 358 micrograms ($1.1\times10^{-6}$ mole)of zinc metal, 0.51 milligrams/cc ($2.1\times10^{-6}$ mole/cc) of indium iodide, 0.88 mg/cc ($2.7\times10^{-6}$ mole/cc) of thallium iodide, 1.36 mg/cc ($4.3\times10^{-6}$ mole/cc) of zinc iodide, 0.21 mg/cc ($1.57\times10^{-6}$ mole/cc) of lithium iodide and xenon. The xenon is present in the arc chamber at a pressure of about 300 torr. By mg/cc is meant mg per cc of arc tube volume.

FIG. 4 is a curve of the spectral emission of a lamp of the type, dimensions and containing the fill set forth above and depicted in FIG. 3. This lamp was operated at 100 watts at a nominal input voltage of about 80 volts and had a total light output of about 12,889 lumens. This type of lamp is useful for visual applications such as in a projection color TV and had a color temperature of 6000° K. Referring to FIG. 4, one observes that the spectral distribution of the visible emission is similar to that of FIG. 2, but is obviously not as "cleanly" concentrated in the desired bands of blue, green and red due to the emission radiated by the mercury. Nevertheless, the blue, green and red emission is still more localized or separated than most metal halide lamps and the lamp of this embodiment of the present invention is therefore more efficient at producing the desired radiation.

What is claimed is:

1. A metal halide arc discharge lamp emitting primarily in the blue, green and red portions of the visible light spectrum and not continuously across the visible spectrum and with a significant amount of blue emission at a wavelength of about 450 nm, said lamp comprising a light transmissive, vitreous, hermetically sealed arc chamber enclosing within a pair of electrodes, an inert gas, at least one halogen indium, zinc, lithium and thallium, wherein the amount of indium present is not greater than about 25 mole % of the total of said four metals and wherein said halogen is present in an amount sufficient to insure that said metals are present as metal halides during operation of said lamp, but not in excess of that amount.

2. The lamp of claim 1 wherein the blue to red energy emission ratio ranges from about 0.8:1 to about 11:1.

3. The lamp of claim 2 wherein said inert gas comprises one or more noble gases.

4. The lamp of claim 3 wherein said noble gases are selected from the group consisting essentially of xenon, argon, krypton and mixture thereof.

5. The lamp of claim 4 wherein said halogen is selected from the group consisting essentially of iodine, bromine, chlorine and mixture thereof.

6. The lamp of claim 5 wherein said blue to red energy ratio is at least about 1:1.

7. The lamp of claim 6 wherein the amount of said metal present in said arc chamber in moles per cubic centimeter of arc tube volume ranges from about $4\times10^{-8}$ to $6\times10^{-6}$ for indium, $6\times10^{-8}$ to $5\times10^{-6}$ for zinc, $7\times10^{-8}$ to $2\times10^{-5}$ for lithium and $6\times10^{-8}$ to $3\times10^{-6}$ for thallium.

8. The lamp of claim 7 wherein said blue, green and red portions predominantly radiate at about 400–480 nm, 500–560 nm and 600–700 nm, respectively.

9. The lamp of claim 7 wherein said halogen is selected from the group consisting essentially of iodine, bromine and mixture thereof.

10. The lamp of claim 9 wherein said arc tube also contains mercury.

11. The lamp of claim 10 wherein said mercury is present in said arc tube in an amount of less than about $5\times10^{-6}$ moles per cubic centimeter of arc tube volume.

12. The lamp of claim 10 wherein said mercury does not exceed about $1.25\times10^{-6}$ moles/cc.

13. A metal halide arc discharge lamp emitting primarily in the blue, green and red portions of the visible light spectrum and not continuously across the visible spectrum and with a significant amount of blue emission at a wavelength of about 450 nm and a blue to red energy emission ratio of from about 0.8:1 to 11:1, said lamp comprising a light transmissive, vitreous arc tube having an arc chamber therein and enclosing a pair of electrodes which protrude into said arc chamber and are hermetically sealed in said arc tube to provide an arc having a length greater than about 3 cm, said arc chamber containing a noble gas, indium, zinc, lithium, thallium, and at least one halogen, said indium being present in an amount no greater than about 25 mole % of the combined total of said four metals and said halogen being present in an amount sufficient to insure that at least a portion of each of said metals is present as metal halide during operation of said lamp, but not in excess of that amount.

14. The lamp of claim 13 wherein said halogen is selected from the group consisting essentially of iodine, bromine, chlorine or mixtures thereof.

15. The lamp of claim 14 wherein said halogen is selected from the group consisting essentially of iodine and bromine.

16. The lamp of claim 15 wherein said blue, green and red color bands are defined as ranging from about 400–480 nm, 500–560 nm, and 600–700 nm, respectively.

17. The lamp of claim 16 wherein said noble gas is selected from the group consisting of xenon, argon, krypton and mixture thereof.

18. The lamp of claim 17 wherein the amount of said metal present in said arc chamber in moles per cubic centimeter of arc tube volume ranges from about $4\times10^{-8}$ to $6\times10^{-6}$ for indium, $6\times10^{-8}$ to $5\times10^{-6}$ for zinc, $7\times10^{-8}$ to $2\times10^{-5}$ for lithium and $6\times10^{-8}$ to $3\times10^{-6}$ for thallium.

19. The lamp of claim 18 wherein said indium is present in said arc chamber in an amount ranging from about $7\times10^{-8}$ to $2.5\times10^{-6}$ moles per cc of arc tube volume.

20. The lamp of claim 19 wherein the blue to red energy emission ratio exceeds about 1:1.

21. The lamp of claim 20 exhibiting substantially little or no light emission ranging between about 480–510 nm and 570–600 nm.

22. The lamp of claim 18 also having zinc or indium metal present in said arc chamber.

23. The lamp of claim 18 wherein said indium halide present in said arc chamber ranges between about $1.4\times10^{-8}$ to $2.0\times10^{-6}$ moles/cc.

24. The lamp of claim 18 additionally containing mercury in the arc chamber.

25. The lamp of claim 24, wherein the amount of said mercury present in said arc chamber is less than about $5\times10^{-6}$ moles/cc.

26. The lamp of claim 24 wherein the amount of said mercury in said arc chamber is less than about $1.25\times10^{-6}$ mole/cc.

27. A compact metal halide arc discharge lamp emitting primarily in the blue, green and red portions of the visible light spectrum and not continuously across the visible spectrum and with a significant amount of blue emission at a wavelength of about 450 nm and a blue to red energy emission ratio of from about 0.8:1 to 11:1, said lamp comprising a light transmissive, vitreous arc tube containing an arc chamber having a pair of electrodes protruding into said arc chamber and being hermetically sealed therein and having an arc length of not more than about 3 cm, said arc chamber containing mercury, a noble gas, indium, zinc, lithium, thallium and at least one halogen, said halogen being present in an amount sufficient to insure that substantially all of said indium, zinc, lithium and thallium is present as metal halide during operation of said lamp, but not in excess of that amount and said indium being present in an amount not exceeding about 35 mole % of the combined total of said indium, zinc, lithium and thallium.

28. The lamp of claim 27 wherein mercury is present in said arc chamber in an amount ranging from about $2.5\times10^{-5}$ to $2\times10^{-4}$ moles/cc of arc chamber volume.

29. The lamp of claim 28 said noble gas is selected from the group consisting of xenon, argon, krypton and mixture thereof.

30. The lamp of claim 29 wherein said mercury present in said arc chamber generally ranges between about $1\times10^{31\ 4}$ to $1.75\times10^{-4}$ moles/cc.

31. The lamp of claim 28 wherein the amount of indium present in said arc chamber ranges from about $7\times10^{-8}$ to $6\times10^{-6}$ moles/cc.

32. The lamp of claim 27 in combination with a reflector.

33. The lamp of claim 32 wherein said reflector is glass.

* * * * *